United States Patent [19]

Neil

[11] Patent Number: 4,582,450

[45] Date of Patent: Apr. 15, 1986

[54] UNIVERSAL MANHOLE ADJUSTING RING

[76] Inventor: Ronald Neil, 215 E. 8th St., Pella, Iowa 50219

[21] Appl. No.: 659,414

[22] Filed: Oct. 10, 1984

[51] Int. Cl.[4] ..... E02D 29/14

[52] U.S. Cl. ..... 404/26; 52/20

[58] Field of Search ..... 404/22, 25, 26; 52/19–21

[56] References Cited

U.S. PATENT DOCUMENTS

| | | | |
|---|---|---|---|
| 2,109,287 | 2/1938 | Elkington | 404/25 |
| 3,218,943 | 9/1963 | Bowman | 404/26 |
| 3,773,428 | 11/1973 | Bowman | 404/26 |
| 3,968,600 | 7/1976 | Bowman | 404/26 X |
| 4,187,647 | 2/1980 | Hall | 404/26 X |
| 4,281,944 | 8/1981 | Bowman | 404/26 |

FOREIGN PATENT DOCUMENTS

| | | | |
|---|---|---|---|
| 19453 | 2/1977 | Japan | 404/26 |
| 503412 | 4/1939 | United Kingdom | 404/25 |

OTHER PUBLICATIONS

Engineering News Record, "Rattlefree and Easily Shimmed", 1957.

*Primary Examiner*—Stephen J. Novosad
*Assistant Examiner*—John F. Letchford
*Attorney, Agent, or Firm*—Zarley, McKee, Thomte, Voorhees & Sease

[57] ABSTRACT

An adjustment ring for raising a cover which fits over an opening of a casting fixed in a road surface is provided and comprises a plurality of ring sections mounted upon the casting. Each section has spaced apart first and second ends with the first end of each section being adapted to overlap the second end of each adjacent section such that the overlapping ends of the consecutively adjacent sections form the ring into a shape complimentary to that of the casting. The overlapping sections are secured to one another by screws. The perimeter of the ring can be adjusted by altering the extent of overlap between adjacent sections. Each section includes a support surface for supporting the cover or grate.

24 Claims, 6 Drawing Figures

UNIVERSAL MANHOLE ADJUSTING RING

BACKGROUND OF THE INVENTION

Generally, manhole covers and storm sewer grates are supported by a metal casting which is fixed in the road such that the cover or grate is at the same elevation as the road surface. However, when the road is resurfaced or repaired, the casting is considerably below the level of the new road surface such that the cover or grate is also not level with the new surface, creating driving hazards. While various adjustment rings have been employed to raise the cover to the level of the new road surface, such rings typically are difficult and awkward to set into position and are not adjustable for covers of varying thicknesses.

Therefore, a primary objective of the present invention is the provision of an adjustment ring which can be positioned on the old casting to raise the manhole cover or storm grate to the same elevation as the resurfaced road.

Another objective of the present invention is the provision of an adjustment ring which will fit various sized manhole castings and storm sewer castings.

Another objective of the present invention is the provision of an adjustment ring for manhole covers and the like which can be easily positioned by one person.

Still a further objective of the present invention is the provision of an adjustable ring which can be adapted for manhole covers having various thicknesses.

An additional objective of the present invention is the provision of a sectioned ring wherein the perimeter of the ring can be varied.

A further objective of the present invention is the provision of an adjustment ring having vertically adjustable height.

These and other objectives will become apparent from the following description of the invention.

SUMMARY OF THE INVENTION

The adjustment ring of the present invention for manholes, storm sewers, and the like is mounted upon the existing casting so that the manhole cover or storm grate can be raised to the elevation of a newly resurfaced road. The ring comprises a plurality of ring sections each having an inner ring portion with an upper surface for supporting the cover or grate and an integrally formed outer ring portion with a lower surface for supporting the section on the casting. The outer ring portion further includes an outer peripheral edge, an inner peripheral edge, and spaced apart first and second ends. The first end of each section has a plurality of teeth extending inwardly from the outer peripheral edge while the second end of each section has a plurality of teeth extending outwardly from the inner peripheral edge. The first end of each section is adapted to overlap a portion of the second end of the adjacent section such that the teeth of the respectively overlapping ends intermesh with one another to hold the sections in their relative positions. The perimeter of the ring can be increased or decreased by varying the number of overlapping teeth, accordingly. The overlapping ends of adjacent sections are secured to one another by a screw.

The vertical height of each section can be adjusted by a vertically adjustable support leg extending downwardly from the inner ring portion so as to engage the support flange of the casting. Spacer shims can be positioned between the outer ring portion of each section and the casting to further stabilize the sections. Additional shims can be positioned on the top surface of the outer ring portion to provide a raised outer ring surface which is at the same elevation as the new road surface. Finally, deformable wedge-shaped members can be placed between the overlapping ends of adjacent sections such that the contour of the ring more closely approximates that of the casting.

DETAILED DESCRIPTION OF THE DRAWINGS

Figures 1, 2, 3, 4:
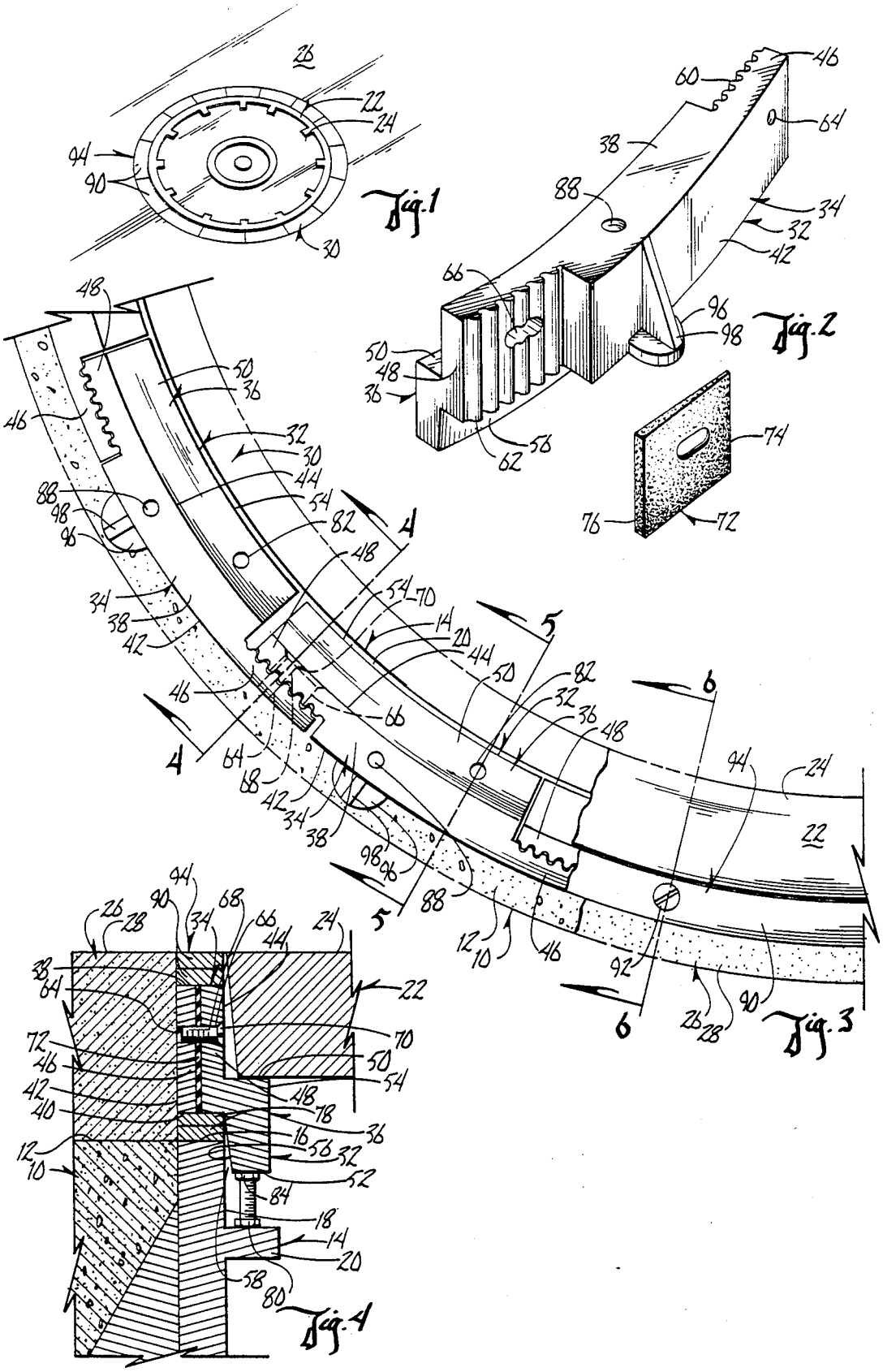
FIG. 1 is a view showing the manhole adjustment ring in use with a standard manhole cover.
FIG. 2 is a perspective view of one section of the adjustment ring of the present invention.
FIG. 3 is a top plan view of a portion of the adjustment ring of the present invention.
FIG. 4 is a sectional view taken along lines 4—4 of FIG. 3.
Figure 5:
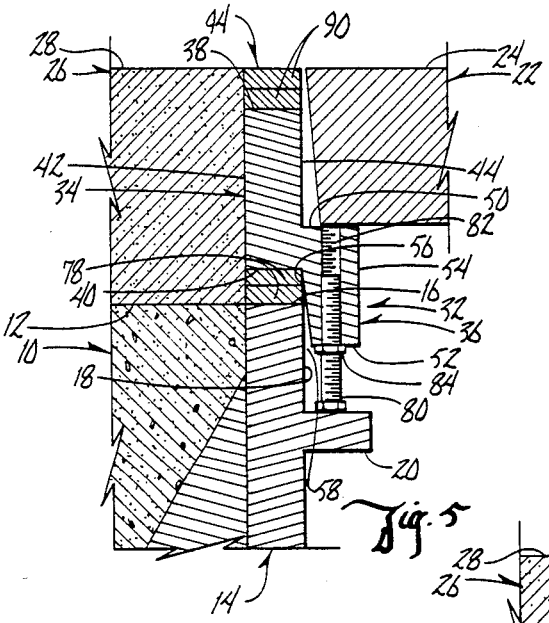
FIG. 5 is a sectional view taken along lines 5—5 of FIG. 3.
Figure 6:
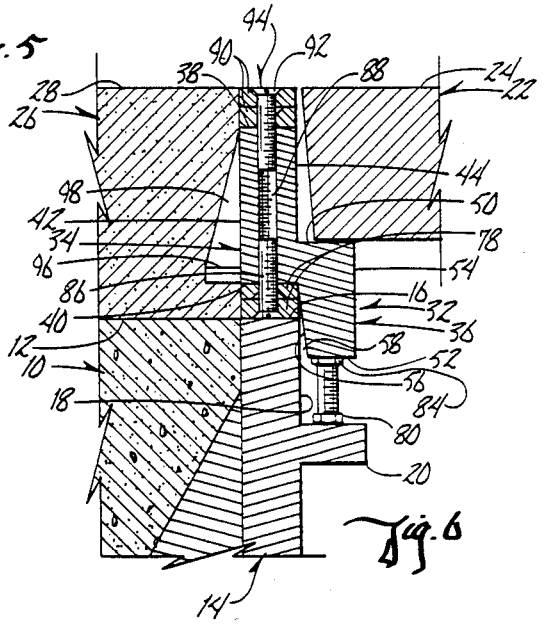
FIG. 6 is a sectional view taken along lines 6—6 of FIG. 3.

In the drawings, the numeral 10 generally designates an original road bed with an upper surface 12 in which a casting 14 for a manhole, storm drain, or the like is fixed. Casting 14 is typically made of metal and includes a top edge 16 which is flush with upper surface 12 of road bed 10, an inner wall 18 and an inwardly extending support flange 20 used to support a cover or grate 22 typically placed over the opening defined by the casting. Ideally, the upper surface 24 of cover 22 is also at the same elevation as upper surface 12 of road bed 10 to provide a smooth ride for a car, bikes or the like passing over the road. There is no standard design in the industry for casting 14 and cover 22 and therefore the various dimensions of casting 14 and cover 22 tend to vary from one community to another.

The inherent wear and tear that a road is subjected to oftens requires the road to be resurfaced. In the drawings, the resurfacing material is generally designated by the numeral 26 with the upper surface thereof being designated by the numeral 28. Since resurfacing material 26 is usually laid directly upon upper surface 12 of original road bed 10 and is two to three inches thick, it is necessary to raise cover 22 such that upper surface 24 thereof is again level with the new upper surface 28 of the resurfaced road.

The present invention raises the vertical height of cover 22 by providing a universal adjustment ring 30 which is mounted upon casting 14 so as to raise upper surface 24 of cover 22 to the elevation of the new road surface. Ring 30 is comprised of a plurality of ring sections 32 which are adapted to overlap one another so as to conform to the shape of casting 14. Preferably, for use in a circular manhole, ring 30 includes 15 uniformly curved sections which interlock to form a circular ring. For other types of openings in road bed 10, such as storm drains, sections 32 may be linear and/or angular so as to conform to the shape of the particular casting. Except for the particular curve or angle of a section, all sections 32 are substantially identical and similar parts will be numbered identically in the drawings as hereinafter described.

Each section 32 includes an outer ring portion 34 and an integrally formed inner ring portion 36. Outer ring portion 34 has an upper surface 38, a lower surface 40, an outer peripheral wall 42, an inner peripheral wall 44, a first end 46, and a spaced apart second end 48. Inner ring portion 36 has an upper surface 50, a lower surface 52, an inner peripheral wall 54, and an inwardly tapered outer peripheral wall 56.

First end 46 of outer end portion 34 has a plurality of teeth 60 extending inwardly from outer peripheral wall 42. Similarly, second end 48 has a plurality of teeth 62 extending outwardly from inner peripheral wall 44. First end 46 of each of sections 32 is adapted to overlap second end 48 of the next adjacent section whereby at least some of teeth 60 engage some of complimentarily shaped teeth 62 thereby maintaining the relative position of the adjacent sections with respect to one another. By altering the number of teeth 60 and 62 which engage one another between adjacent sections, the perimeter of ring 30 can be increased or decreased to fit the particular casting 14 upon which ring 30 is mounted. For example, the diameter of ring 30 can be increased or decreased by overlapping more or less teeth, respectively, to adjust the size of ring 30 to a particular manhole casting. Thus, ring 30 of the present invention can be universally utilized in the non-standardized manhole castings existing in various communities.

Means are also provided for securing the overlapping ends of adjacent sections together. More particularly, first end 46 has a threaded hole 64 therein and second end 48 has an elongated slot 66 extending therethrough which aligns hole 64 of the overlapping first end of the adjacent section. A screw 68 extends through slot 66 and is threadably received by hole 64 to secure the overlapping sections together. Slot 66 is countersunk such that head 70 of screw 68 is flush with inner peripheral wall 44 of outer ring portion 34 so as not to interfere with the placement of cover or grate 22 on ring 30.

A wedge-shaped member 72 can be positioned as needed between the overlapping ends of adjacent sections to increase or decrease the perimeter of ring 30 such tha the ring more closely conforms to an irregularly shaped casting. Member 72 is made of a deformable material so that the member will conform to the shape of the intermeshing teeth 60 and 62. Wedge member 72 has a first narrow end 74 and a thicker spaced apart second end 76.

In use, ring 30 is positioned on casting 14 such that lower surface 40 of outer ring portion 34 engages top edge 16 of casting 14 whereby inner ring portion 36 extends downwardly adjacent inner wall surface 18 of casting 14 and such that an expansion space 58 is maintained between inwardly tapered outer peripheral wall 56 of inner ring 36 and inner wall surface 18 of casting 14. Sections 32 can be positioned by one person on casting 14 one at a time with the amount of overlap of adjacent sections being selected or changed as needed to conform the shape of ring 30 to that of casting 14. Cover 22 is supported by upper surface 50 of inner ring portion 36.

If the thickness of resurfacing material 26 is greater than the overall height of outer ring portion 34, a plurality of shims 78 can be positioned between lower surface 40 of outer ring portion 34 and top edge 16 of casting 14. An adjustment bolt 80 adjustably threadably received within a vertically oriented hole 82 can then be adjusted downwardly from lower surface 52 of inner ring portion 36 such that upper surface 50 is vertically raised to bring upper surface 24 of cover 22 level with the new road surface 28. A lock nut 84 locks adjustment bolt 80 in the selected position. Also, shims 78 are secured to ring 30 by a screw 86 extending upwardly and threadably received within a vertically oriented hole 88 extending through outer ring portion 34. As an alternative to shims 78, an adjustment bolt similar to bolt 80 can be adjustably threadably received in hole 88 to raise the height of each section 32. Similarly, shims could be utilized between lower surface 52 of inner ring portion 36 in place of adjustment bolt 80. At a minimum, inner peripheral wall 44 of outer ring portion 34 and outer peripheral wall 56 of inner ring portion 36 have a height equal to the thinest cover or grate manufactured by the industry. In such a situation, lower surface 52 of inner ring portion 36 engages support flange 20 for additional support of section 32. If the thickness of cover or grate 22 is such that upper surface 24 thereof is at a higher elevation than upper surface 38 of outer ring portion 34 when the cover is supported by upper surface 50 of inner ring portion 36, additional shims 90 can be secured to upper surface 38 of outer ring portion 34 by a screw 92 extending downwardly into vertically oriented hole 88 to provide a new upper surface 94 which is at the same elevation as upper surface 24 of cover 22 and the new road surface 28.

Each section 32 may also include an outwardly extending ear 96 connected to outer peripheral wall 42 of outer ring portin 34 by welding or the like and reinforced by interconnecting web 98 so as to anchor sections 32 into resurfacing material 26.

Thus, from the above description, it can be seen that regardless of resurfacing material 26, regardless of the thickness of cover or grate 22, and regardless of the shape of casting 14, a novel adjustment ring 30 comprised of overlapping sections 32 can be utilized to raise upper surface 24 of cover or grate 22 to the elevation of the new road surface 28. Therefore, at least all of the stated objectives are accomplished by the adjustment ring of the present invention.

What is claimed is:

1. An adjustment ring for raising a cover which normally fits over an opening of a casting fixed in a support surface to the elevation of said support surface, said ring comprising:

a plurality of ring sections supported by said casting and having spaced apart first and second ends, said first end of each of said ring sections being adapted to overlap said second end of each adjacent ring section such that the overlapping ends of the consecutively adjacent ring sections form said ring into a shape complimentary to that of said casting, each of said first and second ends of said sections having a plurality of teeth, said teeth of said first end being disposed in a direction opposite to that of said teeth in said second end such that at least some of said teeth of said overlapping ends intermesh with one another, support means on said sections for supporting said cover, and securing means for securing said overlapping ends together.

2. The adjustment ring of claim 1 wherein each of said sections further includes anchoring means for anchoring said section to said support surface.

3. The adjustment ring of claim 1 wherein each of said sections further includes an adjustable leg extending downwardly therefrom for engaging a casting for support thereby.

4. The adjustment ring of claim 1 wherein said sections are uniformly curved to form a circular ring.

5. The adjustment ring of claim 1 wherein some of said sections are linear and others of said sections are angular.

6. The adjustment ring of claim 1 wherein said securing means includes a threaded first hole in said first end, a second hole in said second end, said first and second holes of said overlapping ends being aligned and a screw extending through said second hole and being threadably received in said first hole.

7. The adjustment ring of claim 6 wherein said second hole is an elongated slot for maintaining alignment of said first and second holes while the number of intermeshing teeth varies whereby the perimeter of said ring is adjustable.

8. The adjustment ring of claim 1 further comprising first means selectively positoned between said sections and said casting for raising said cover to the level of said supporting surface.

9. The adjustment ring of claim 8 further comprising second means secured to said sections for providing an upper ring surface at the same elevation as said cover and said supporting surface.

10. A manhole adjustment ring for adjusting the vertical height of a manhole cover placed over the opening of a manhole casting anchored in resurfaced road, said casting being a cylindrical housing with a top edge, an inner wall and a support flange spaced downwardly from said top edge and extending inwardly from said inner wall, said ring comprising:

a plurality of curved ring sections supported on said casting and each section having an inner ring portion for supporting said manhole cover and an integrally formed outer ring portion, said outer ring portion having an outer peripheral edge, and inner peripheral edge, and spaced apart first and second ends, said first end of said outer ring portion of each of said sections being adapted to overlap at least a portion of said second end of said outer ring portion of each adjacent section, said first end having a plurality of teeth extending inwardly from said outer peripheral edge and said second end having a plurality of teeth extending outwardly from said inner peripheral edge such that said teeth of the respective overlapping ends intermesh, and means for securing said overlapping ends together.

11. The manhole adjustment ring of claim 10 wherein said means for securing said overlapping ends together is adjustable such that the number of said teeth of the respective overlapping ends of the adjacent sections which intermesh with one another is variable whereby the perimeter of said ring is adjustable.

12. The manhole adjustment ring of claim 10 wherein said means for securing said overlapping ends together includes a threaded hole in said first end of each of said sections, an elongated slot extending through said second end of each of said adjacent sections, said hole and said slot of said overlapping ends being aligned, and a screw adapted to extend through said elongated slot and be threadably received by said hole.

13. The manhole adjustment ring of claim 10 wherein each of said sections further includes an anchoring means for anchoring said section in said resurfaced road.

14. The manhole adjustment ring of claim 10 wherein said inner ring portion has an inwardly tapered outer peripheral edge so as to provide an expansion space between said inner ring portion and said inner wall of said manhole casting.

15. The manhole adjustment ring of claim 10 wherein each of said sections further includes a vertically adjustable support leg extending downwardly therefrom so as to engage said manhole casting to support said section thereon.

16. The manhole adjusting ring of claim 10 further comprising first shim means secured between said manhole casting and said sections for raising the vertical height of said sections.

17. The manhole adjusting ring of claim 10 further comprising second shim means secured to said outer ring portion for providing a raised outer ring surface at the same elevation as said manhole cover.

18. The manhole adjustment ring of claim 10 further comprising a wedge member placed between at least one of said overlapping ends of adjacent sections whereby the shape of said ring more closely approximates that of said manhole casting.

19. The manhole adjustment ring of claim 18 wherein said anchoring means comprises an outwardly extending ear attached to said outer ring portion.

20. The manhole adjustment ring of claim 18 wherein said wedge member is deformable and molds to the contour of said intermeshing teeth.

21. A manhole adjustment ring for adjusting the vertical height of a manhole cover placed over the opening of a manhole casting anchored in a resurfaced road, said casting being a cylindrical housing with a top edge, an inner wall and a support flange spaced downwardly from said top edge and extending inwardly from said inner wall, said ring comprising:

a plurality of curved ring sections supported on said casting and each section having an inner ring portion for supporting said manhole cover and an integrally formed outer ring portion, said outer ring portion having an outer peripheral edge, and inner periheral edge, and spaced apart first and second ends, said first end of said outer ring portion of each of said sections being adapted to overlap at least a portion of said second end of said outer ring portion of each adjacent section, and means for securing said overlapping ends together, said means for securing said overlapping ends together including a threaded hole in said first end of each of said sections, an elongated slot extending through said second end of each of said adjacent sections, said hole and said slot of said overlapping ends being aligned, and a screw adapted to extend through said elongated slot and be threadably received by said hole.

22. An adjustment ring for raising a cover which normally fits over an opening of a casting fixed in a support surface to the elevation of said support surface, said ring comprising:

a plurality of ring sections supported by said casting and having spaced apart first and second ends, said first end of each of said ring sections being adapted to overlap said second end of each adjacent ring section such that the overlapping ends of the consecutively adjacent ring sections form said ring into a shape complimentary to that of said casting, support means on said sections for supporting said cover, and securing means for securing said overlapping ends together, said means for securing said overlapping ends together including a threaded hole in said first end of each of said sections, an elongated slot extending through said second end of each of said adjacent sections, said hole and said slot of said overlapping ends being aligned, and a screw adapted to extend through said elongated slot and be threadably received by said hole.

23. The adjustment ring of claim 22 wherein said sections are uniformly curved to form a circular ring.

24. The adjustment ring of claim 22 wherein some of said sections are linear and others of said sections are angular.

* * * * *